US006363344B1

(12) United States Patent
Higuchi

(10) Patent No.: US 6,363,344 B1
(45) Date of Patent: Mar. 26, 2002

(54) SPEECH COMMUNICATION APPARATUS AND METHOD FOR TRANSMITTING SPEECH AT A CONSTANT LEVEL WITH REDUCED NOISE

(75) Inventor: Koji Higuchi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/749,502

(22) Filed: Nov. 15, 1996

(30) Foreign Application Priority Data

Jun. 3, 1996 (JP) ..... 8-140231

(51) Int. Cl.[7] ..... G10L 21/02
(52) U.S. Cl. ..... 704/226; 704/228; 379/389
(58) Field of Search ..... 704/224–228; 381/92–95, 379, 389, 390, 409, 410

(56) References Cited

U.S. PATENT DOCUMENTS 4,628,529 A * 12/1986 Borth et al. ..... 381/94
4,630,305 A * 12/1986 Borth et al. ..... 381/94
4,811,404 A * 3/1989 Vilmur et al. ..... 381/94
5,012,519 A * 4/1991 Adlersberg et al. ..... 381/47
5,471,538 A * 11/1995 Saski et al. ..... 381/92
5,473,684 A * 12/1995 Bartlett et al. ..... 379/387
5,490,219 A * 2/1996 Badie et al. ..... 381/122
5,568,559 A * 10/1996 Makino ..... 381/98
5,586,191 A * 12/1996 Elko et al. ..... 381/92
5,659,622 A * 8/1997 Ashley ..... 381/94
5,673,325 A * 9/1997 Andrea et al. ..... 381/92
5,721,771 A * 2/1998 Higuchi et al. ..... 379/389
5,854,845 A * 12/1998 Itani ..... 381/108

* cited by examiner

*Primary Examiner*—Fan Tsang
*Assistant Examiner*—Michael N. Opsasnick
(74) *Attorney, Agent, or Firm*—Rothwell, Figg, Ernst & Manbeck

(57) ABSTRACT

An apparatus comprising a noise component removing means for removing specific noise components from input voice, and a level adjusting means for amplifying the voice signal after the removal of the specific noise components to obtain a constant-level output, wherein the voice signal after level adjustment is transmitted. Further, the noise component removing means may be constituted by a high-pass filter. Further, the level adjusting means may be constituted by a rectifying circuit, an integrating circuit and an automatic volume amplifier adjusted on the basis of the output of the integrating circuit. Further, the level adjusting means may be constituted by an A/D converter, a voice power calculating portion, a voice power comparator and a digital volume adjuster adjusted on the basis of a value after the power calculation and comparison.

10 Claims, 8 Drawing Sheets

SPEECH COMMUNICATION APPARATUS AND METHOD FOR TRANSMITTING SPEECH AT A CONSTANT LEVEL WITH REDUCED NOISE

BACKGROUND OF THE INVENTION

1. Field of the Invention

The present invention relates to a speech apparatus for transmitting voice signals in which ambient noise at a wired or wireless transmitter location is reduced so that a high quality voice signal is transmitted.

2. Description of the Related Art

FIG. 8 is a configuration diagram showing a conventional example of speech apparatus.

In FIG. 8, the reference numeral 91 designates a transmission signal microphone; 92, a transmitter side output terminal; 93, a voice detector for detecting transmission voice; and 94, an attenuator for attenuating the transmission signal on the basis of the output of the voice detector.

The operation of the apparatus having the aforementioned configuration will be described below.

In addition to a near-end speaker's voice 101 inputted to the transmission signal microphone 91, near-end ambient noise 102 is also inputted to the microphone.

The voice detector 93 detects the near-end speaker's voice 101 inputted to the transmission signal microphone 91. When there is no voice 101, that is, when there is only ambient noise 102, the attenuator 94 for attenuating the transmission signal is operated so that the transmission signal is attenuated. When there is voice 101, contrariwise, the voice detector makes the attenuator 94 inoperative so that the transmission voice is not attenuated.

The conventional speech apparatus configured as above has the following problem.

The level of the near-end speaker's voice varies correspondingly to the near-end ambient noise. This is because a voice amplifying operation is carried out in order to improve the S/N of the near-end speaker's transmission signal so that the voice level increases as the near-end ambient noise increases and that the voice level decreases as the near-end ambient noise decreases. Accordingly, the reception voice level fluctuates relative to the far-end speaker. There arises a problem that the voice is hard to hear.

SUMMARY OF THE INVENTION

The present invention is designed to solve the aforementioned problem, and it is an object of the invention to provide a speech apparatus in which near-end side noise is reduced to reduce the fluctuation of the level of a transmission signal so that the transmission signal easy to hear on the receiver side is transmitted even under noise.

The noise reduced speech apparatus according to the present invention comprises a specific component removing means for removing specific components from input voice, and a level adjusting means for amplifying a voice signal after removal of the specific components to obtain a constant-level output, wherein the voice signal after the level adjustment is transmitted.

Further, the specific component removing means is constituted by a high-pass filter.

Further, the level adjusting means is constituted by a rectifying circuit, an integrating circuit and a voice level adjuster adjusted on the basis of an output of the integrating circuit.

Further, the level adjusting means is constituted by an A/D converter, a voice power calculating portion, a voice power comparator and a digital level adjuster adjusted on the basis of a value after the power calculation and comparison.

Further, the specific component removing means is constituted by a noise collection microphone and a portion equivalent to a subtractor for subtracting noise components collected by the noise collection microphone from the input voice.

Further, a differential microphone with two inputs each which converts input voice into an electric signal is used in place of the specific component removing means, one input of the microphone being used for voice input and noise collection, and the other input being used for noise collection.

Further, a digital noise canceler for performing noise cancellation by frequency analysis of the output of the A/D converter is provided additionally so as to be used as a substitute for the specific component removing means.

Further, a changeover switch for bypassing the level adjusting means is provided-between the specific component removing means and the level adjusting means, and a noise level detecting means is provided so that when the noise level detected by the noise level detecting means is small, the changeover switch is adjusted so that the level adjusting means is bypassed.

Further, a noise level detecting means is provided additionally so that the gain of the level adjusting means is adjusted on the basis of the noise level detected by the noise level detecting means.

The noise reduced speech method according to the present invention comprises the steps of: canceling noise components in an input voice signal; calculating the power of the voice signal after the noise cancellation; comparing the calculated power of the voice signal with a reference voice power level; and adjusting the level of the voice signal after the noise cancellation on the basis of the result of the comparison.

BRIEF DESCRIPTION OF THE DRAWINGS

The above and other objects and features of the present invention will be more apparent from the following description taken in conjunction with the accompanying drawings.

DETAILED DESCRIPTION OF THE PREFERRED EMBODIMENTS

Now, a description will be given in more detail of preferred embodiments of the present invention with reference to the accompanying drawings.

Embodiment 1

A speech apparatus according to Embodiment 1 of the present invention will be described with reference to the drawings.

Figure 1A:
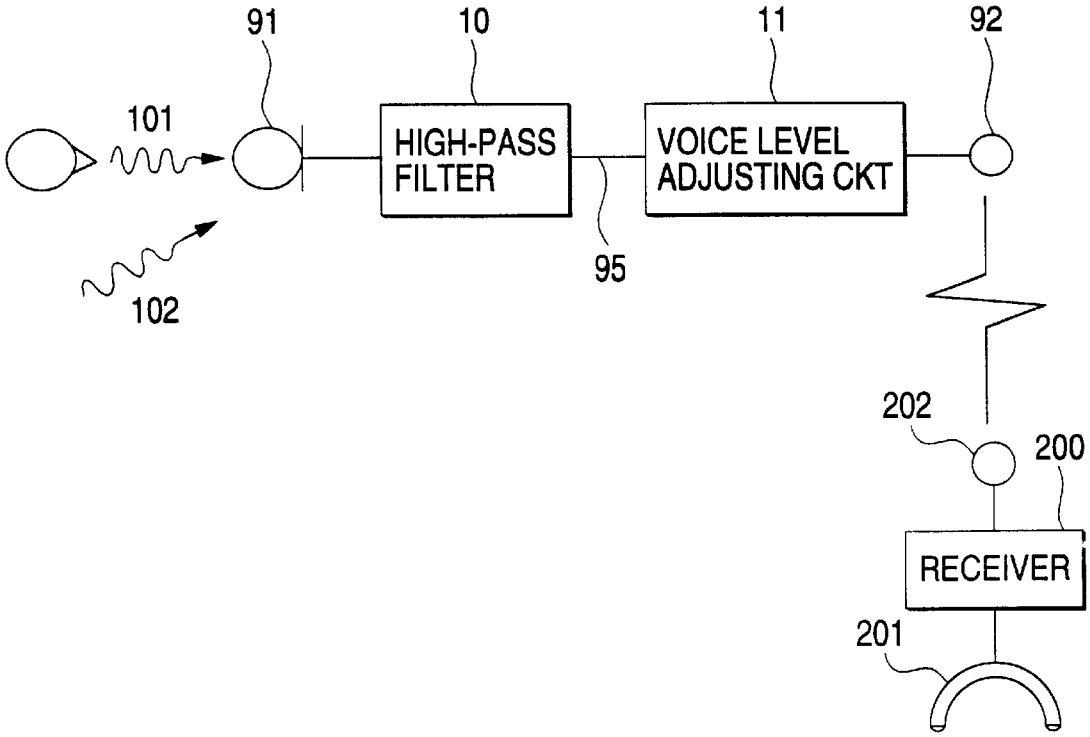
FIGS. 1A and 1B are configuration block diagrams of a noise reduced speech apparatus and a voice level adjustment portion in Embodiment 1 of the present invention.

FIG. 1A is a diagram showing the configuration of the speech apparatus in this embodiment.

In FIG. 1A, the reference numeral 10 designates a high-pass filter for attenuating low-frequency components of an input signal to a transmission signal microphone 91; and 11, a level adjusting circuit for adjusting the level of a transmission signal. The reference numeral 92 designates a transmitter side output terminal through which a transmission signal is transmitted to a far-end side.

Further the reference numeral 200 designates a receiver device for receiving the transmission signal from the transmitter side speech apparatus having the aforementioned configuration; 201, a receiver for converting the reception signal received by the receiver device 201 into voice; and 202, a far-end side (receiver side) input terminal.

The operation of the apparatus having the aforementioned configuration will be described below.

Near-end speaker's voice 101 with ambient noise 102 which enters into the microphone 91, is converted into a transmission signal by the transmission signal microphone 91, and then inputted to the high-pass filter 10.

Because ambient noise is generally concentrated into a low frequency region, the high-pass filter 10 cuts components equivalent to ambient noise by attenuating the low frequency region of the transmission signal which is the output of the transmission signal microphone 91. After improvement in the S/N of the transmission signal, the high-pass filter 10 supplies the signal as a voice signal 95 to the level adjusting circuit 11. Here, the high-pass filter 10 has cut-off frequency characteristic, for example, of 1 KHz.

The level adjusting circuit 11 adjusts the level of a signal to a constant level after ambient noise is removed from the signal by the aforementioned filter. A specific example of the configuration of the level adjusting circuit 11 will be described with reference to FIG. 1B.

Figure 1B:
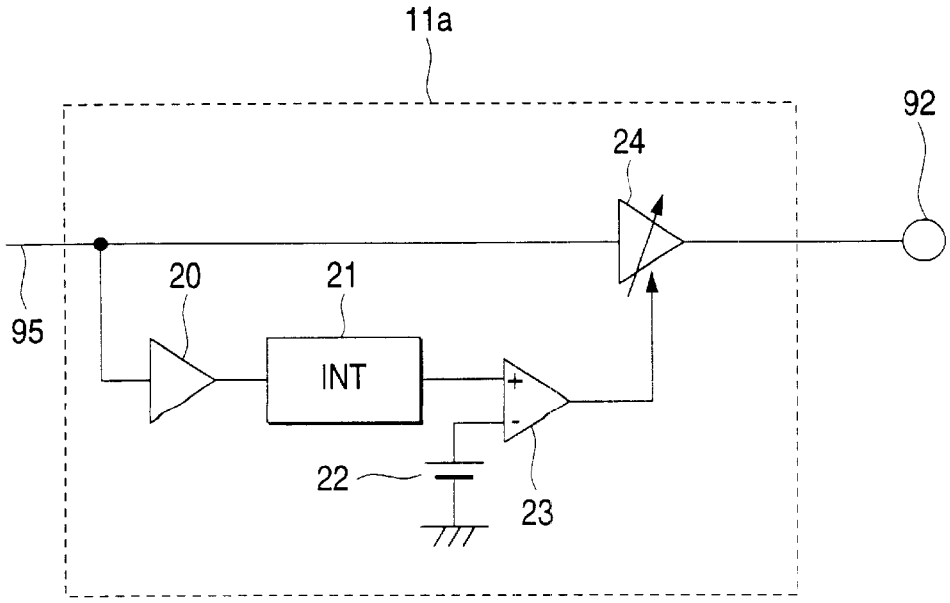

In FIG. 1B, the reference numeral 20 designates a rectifying circuit for converting the input signal from an AC signal into a DC signal; 21, an integrating circuit for integrating the DC signal with respect to a certain time (for example, several milliseconds) to convert the DC signal into another DC voltage; 22, a reference voice voltage for giving a reference voltage corresponding to a moderate transmission voice signal; 23, a comparator for comparing the DC voltage level of the voice with the reference voltage and outputting a signal corresponding to the difference therebetween; and 24, a volume or adjusting circuit for adjusting the level of the transmission signal on the basis of-the signal given from the comparator. The reference numeral 11*a* designates an analog-type voice level adjusting portion constituted by the aforementioned parts. This is one example of the detailed configuration of the level adjusting circuit 11 depicted in FIG. 1A.

The operation of the voice level adjusting portion 11*a* will be described below.

A speaker's voice signal is inputted to both the volume adjusting circuit 24 and the rectifying circuit 20.

The signal inputted to the rectifying circuit 20 is converted from an AC signal into a DC signal. The DC signal is inputted to the integrating circuit 21.

The integrating circuit 21 integrates the intensively fluctuating DC signal with respect to a certain time (for example, several milliseconds) to thereby supply a stabilized DC voltage signal to the comparator 23.

The comparator 23 compares the aforementioned DC voltage signal with the reference voice voltage 22 (which is, for example, set to be 70% of the maximum voice level, as a reference voltage level, and outputs a signal proportional to the difference between the two signals as an adjustment signal for the level adjusting circuit 24. When the level of the DC voltage signal is higher than the reference voltage, the comparator 23 outputs a signal (for example, DC 1 V) so that the gain of the level adjusting circuit 24 is reduced. When the level of the DC voltage signal is contrariwise lower than the reference voltage the comparator 23 outputs a signal (for example, DC 3 V) so that the gain of the level adjusting circuit 24 is increased. When the level of the DC voltage signal is equal to the reference voltage, the comparator 23 outputs a signal (for example, DC 2 V) so that the gain of the level adjusting circuit 24 becomes 0 dB.

The level adjusting circuit 24 adjusts the level of the transmission signal on the basis of the signal given from the comparator 23 and outputs the adjusted signal. When, for example, the level of the output signal of the comparator 23 is 2 V, the level adjusting circuit 24 adjusts the level of the transmission signal to obtain the gain of 0 dB and outputs the adjusted signal, as described above. When, for example, the level of the output signal of the comparator 23 is 1 V, the level adjusting circuit 24 adjusts the level of the transmission signal to obtain the gain of −6 dB and outputs the adjusted signal, as described above. When, for example, the level of the output signal of the comparator 23 is 3 V, the level adjusting circuit 24 adjusts the level of the transmission signal to obtain the gain of +6 dB and outputs the adjusted signal, as described above.

As described above, the-voice level adjusting portion 11*a* compares the level of the fluctuating transmission signal with the reference transmission signal level, and transmits a transmission signal having the level kept constant (reference transmission signal level).

Another specific example of the configuration of the level adjusting circuit 11 will be described below with reference to FIG. 2. This is the case where transmission voice level adjustment is achieved by digital signal processing.

Figure 2:
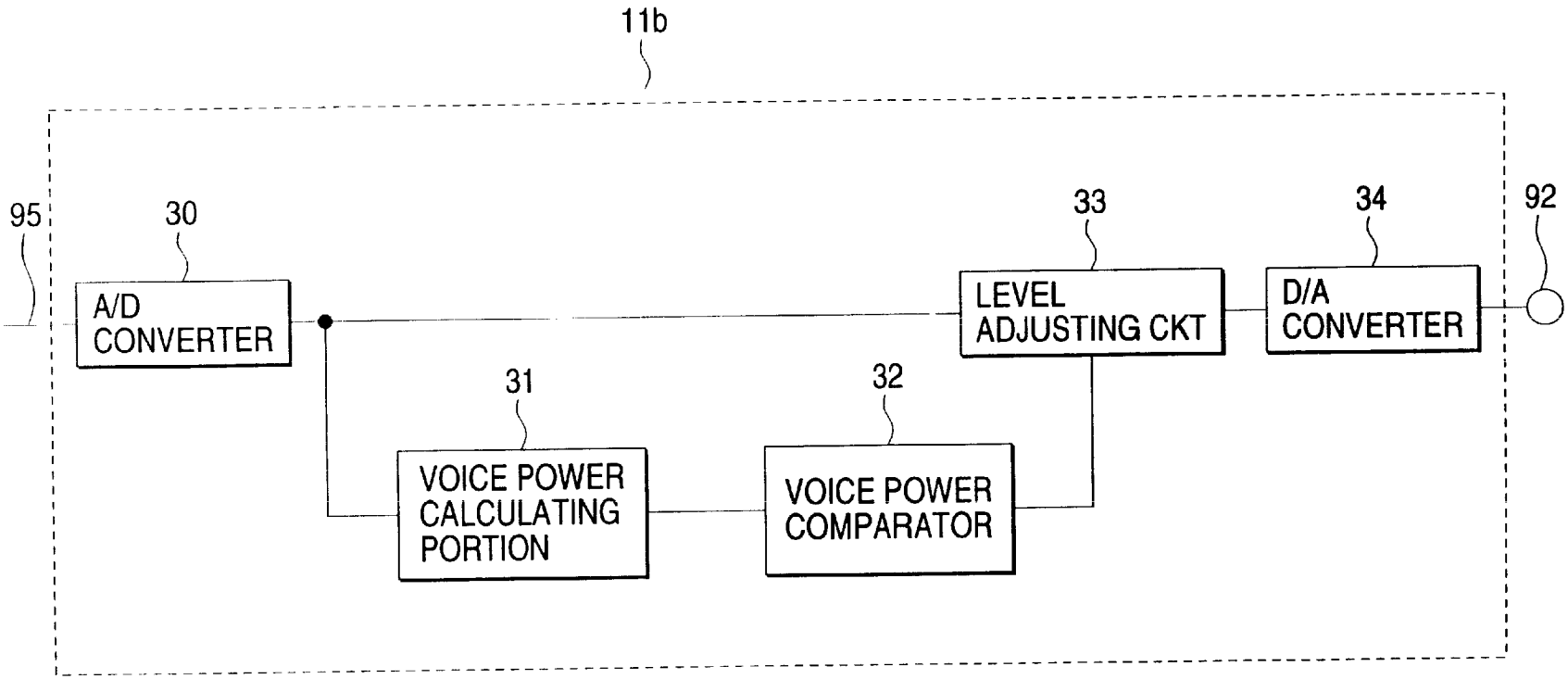
FIG. 2 is a configuration block diagram of a digital voice level adjustment portion.

In FIG. 2, the reference numeral 30 designates an A/D converter for converting an analog voice signal into a digital voice signal; 31, a voice power calculating portion for calculating voice power; 32, a voice power comparator for comparing the calculated voice power with reference voice power and outputting a signal corresponding to the difference between the two power levels; 33, a level adjusting circuit for adjusting the level of the output given from the A/D converter on the basis of the output signal of the voice power comparator; and 34, a D/A converter for converting the digital voice signal into an analog voice signal.

The reference numeral 11*b* designates a digital voice level adjusting portion constituted by the aforementioned parts. A transmitter side output terminal 92 is the same as those shown in FIG. 1A.

The operation of the digital level adjusting portion 11*b* will be described below.

After ambient noise is cut by the high-pass filter 10, a speaker's voice signal 95 is inputted to the A/D converter 30.

The digital signal obtained by conversion in the A/D converter 30 is inputted both to the voice power calculating portion 31 and to the level adjusting circuit 33.

In the voice power calculating portion, the voice power of the input digital signal is calculated, for example, by auto-correlation function calculation which is often used in voice signal processing, or the like.

The calculated voice power level is compared with a reference voice power level (which is, for example, set to be 70% of the maximum voice level, as a reference voice level) stored in the voice power comparator 32 in advance, so that a signal proportional to the difference therebetween is transferred to the level adjusting circuit 33. When, for example, the calculated voice power level is higher than the reference voice power level, a control signal (for example, 5) is supplied to the level adjusting circuit 33 so that the level of the transmission signal is reduced. When, for example, the calculated voice power level is contrariwise lower than the reference voice power level, a control signal (for example, 15) is supplied to the level adjusting circuit 33 so that the level of the transmission signal is increased. When, for example, the calculated voice power level is equal to the reference voice power level, a control signal (for example, 10) is supplied to the level adjusting circuit 33 so that the level of the transmission signal is not changed (the gain is 0 dB).

The level adjusting circuit 33 adjusts the level of the digital voice signal on the basis of the signal given from the voice power comparator 32, and outputs the adjusted signal to the D/A converter 34. For example, the level of the transmission signal is adjusted so as to make the gain 0 dB when the output signal of the voice power comparator 32 is 10, to make the gain −6 dB when the output signal of the voice power comparator 32 is 5, and to make the gain +6 dB when the output signal of the voice power comparator 32 is 15, as described above.

The D/A converter 34 converts the digital voice signal into an analog voice signal; and supplies the analog voice signal to the transmitter side output terminal 92.

As described above, the digital level adjusting portion 11*b* compares the fluctuating level of the transmission signal based on digital signal processing with the reference transmission signal level, and outputs a transmission signal having the level kept constant (reference transmission signal level).

As described above, in the speech apparatus according to this embodiment, ambient noise contained in a transmission signal is removed by the high-pass filter, and the level of transmission voice is kept constant (reference transmission signal level) by the level adjuster in which, specifically, the voice level adjusting portion 11*a* or the digital level adjusting portion 11*b* is used as the level adjusting circuit 11. In this manner, a transmission signal with less fluctuation of the far-end side level can be transmitted with less influence of near-end side ambient noise so that the far-end speaker can hear voice converted by the far-end side receiver device 200 and the receiver 201 with a clear and stable volume.

Embodiment 2

A speech apparatus according to Embodiment 2 of the present invention will be described with reference to the drawing. This embodiment is designed so that ambient noise is collected for cancellation by another microphone as a noise component removing means.

Figure 3:
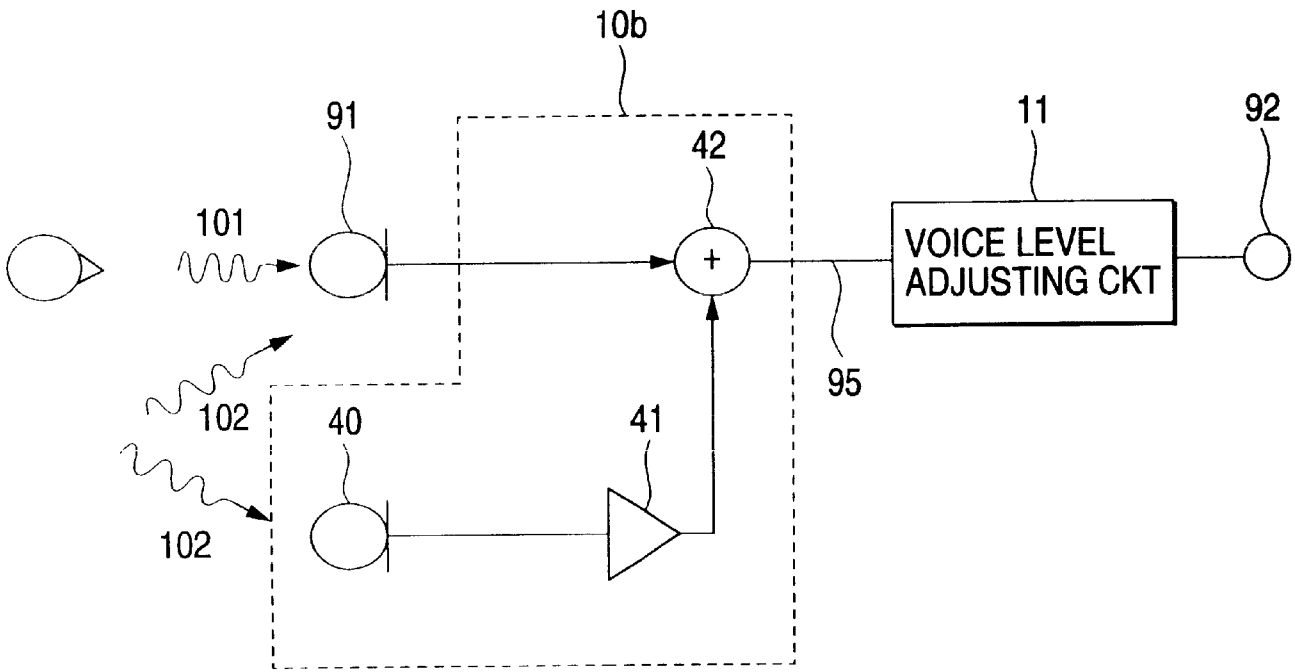
FIG. 3 is a configuration block diagram of a noise reduced speech apparatus in Embodiment 2 of the present invention.

FIG. 3 is a diagram showing the configuration of the speech apparatus in Embodiment 2.

In FIG. 3, the reference numeral 40 designates a noise microphone for converting near-end side ambient noise 102 into a transmission signal; 41, an invertor for inverting the phase of the noise signal by 180 degrees; 42, an adder for adding two signals; and 11, a level adjusting circuit for adjusting the level of the transmission signal. That is, the reference numeral 10*b* designates a specific component removing means. The level adjusting circuit 11 corresponds to the voice level adjusting portion 11*b* in FIG. 1B or the digital level adjusting portion 11*b* in FIG. 2. A transmission signal microphone 91 and a transmitter side output terminal 92 are the same as those shown in FIG. 1A.

The operation of the apparatus having the aforementioned configuration will be described below.

Near-end speaker's voice 101 is converted into a transmission signal by the transmission signal microphone 91, and then the transmission signal is inputted to the adder 42. In this occasion, the transmission signal contains a near-end speaker's voice signal 101, and a signal of near-end side ambient noise 102.

On the other hand, the near-end side ambient noise 102 is converted into a noise signal by the noise microphone 40, and then the noise signal is inputted to the invertor 41.

The invertor 41 inverts the phase of the output signal of the noise microphone 40 by 180 degrees, and supplies the inverted noise signal to the adder 42.

The adder 42 adds the output signal of the transmission signal microphone 91 to the output signal of the invertor 41. In this occasion, noise outputted from the transmission signal microphone and noise outputted from the invertor cancel out each other because the phases thereof are inverted just by 180 degrees from each other. Accordingly, a transmission voice signal having the S/N improved is outputted as an S/N-improved voice signal 95 to the level adjusting circuit 11.

The level adjusting circuit 11 detects the average of transmission signal levels in a certain time, for example, of the order of tens of milliseconds, and supplies the average of the signal having the level kept constant (reference transmission signal level) to the transmitter side output terminal 92 in the same manner as the voice level adjusting portion 11*a* in FIG. 1B or the digital level adjusting portion 11*b* in FIG. 2.

As described above, in the speech apparatus according to this embodiment, ambient noise contained in a transmission signal is removed by cancellation by using two microphones and an adder, and then the transmission signal level is kept constant (reference transmission signal level). Accordingly, a transmission signal without fluctuation of the level can be transmitted to the far-end side without influence of near-end side ambient noise so that the far-end speaker can hear voice with a clear and stable volume.

Embodiment 3

A speech apparatus according to Embodiment 3 of the present invention will be described with reference to the drawing. This embodiment is designed so that noise is collected for cancellation by a differential microphone as a noise component removing means.

Figure 4A:
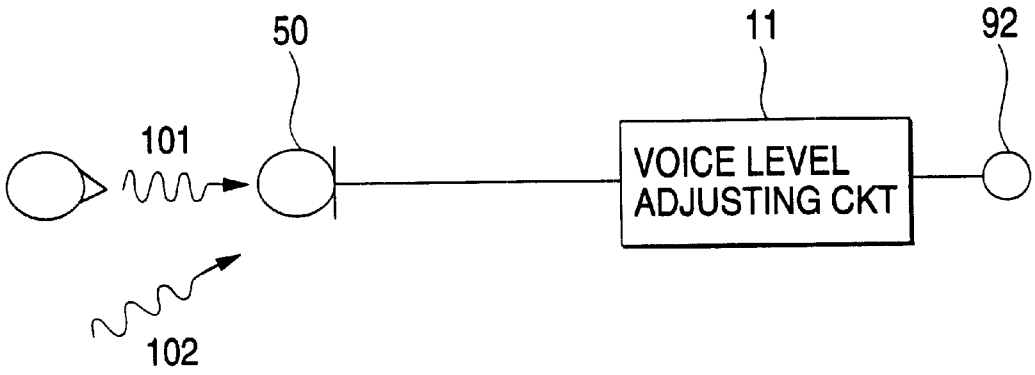
FIGS. 4A and 4B are a configuration block diagram of a noise reduced speech apparatus in Embodiment 3 of the present invention and a diagram showing the directivity characteristic of the differential microphone.

FIG. 4A is a diagram showing the configuration of the speech apparatus in this embodiment.

In FIG. 4A, the reference numeral 50 designates a transmission signal differential microphone. The reference numeral 11 designates a level adjusting circuit for adjusting the level of a transmission signal. The level adjusting circuit 11 corresponds to the voice level adjusting portion 11*a* in FIG. 1B or the digital level adjusting portion 11*b* in FIG. 2. A transmitter side output terminal 92 is the same as that shown in FIG. 1A.

The operation of the apparatus having the aforementioned configuration will be described below.

Figure 4B:
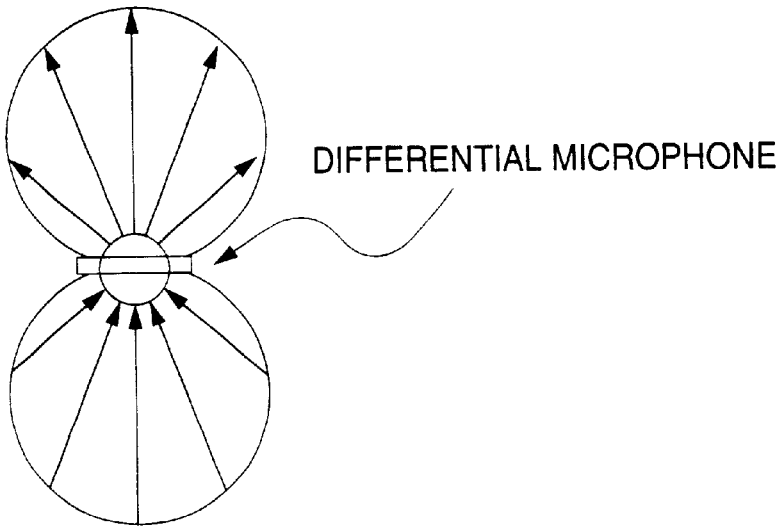

A near-end speaker's voice signal 101 is converted into a transmission signal by the transmission signal differential microphone 50. In this occasion, both the near-end speaker's voice signal 101 and a signal of near-end side ambient noise 102 are inputted to the transmission signal differential microphone. Noise is removed by the function of the differential microphone, so that an S/N-improved transmission signal is inputted to the level adjusting circuit 11. Specifically, a close-talking microphone unit (EM-124) made by Primo Co., Ltd. is an example of the differential microphone 50. The directivity of this microphone is eccentric in the front and the rear as shown in FIG. 4B, so that ambient noise inputted to the front and rear of the microphone simultaneously is canceled out.

The level adjusting circuit 11 keeps the level of the transmission signal constant (reference transmission signal level) and outputs the signal to the transmitter side output terminal 92.

As described above, in the speech apparatus according to this embodiment, ambient noise is removed by using the differential microphone, and then the transmission signal level is kept constant by the level adjusting circuit. Accordingly, a transmission signal with less fluctuation of the far-end side level can be transmitted without influence of near-end side ambient noise so that the far-end speaker can hear voice with a clear and stable volume.

Embodiment 4

A speech apparatus according to Embodiment 4 of the present invention will be described with reference to the drawing. In this embodiment, a digital arithmetic operation portion is used so that the noise component removing means serves also as a level adjuster.

Figure 5:
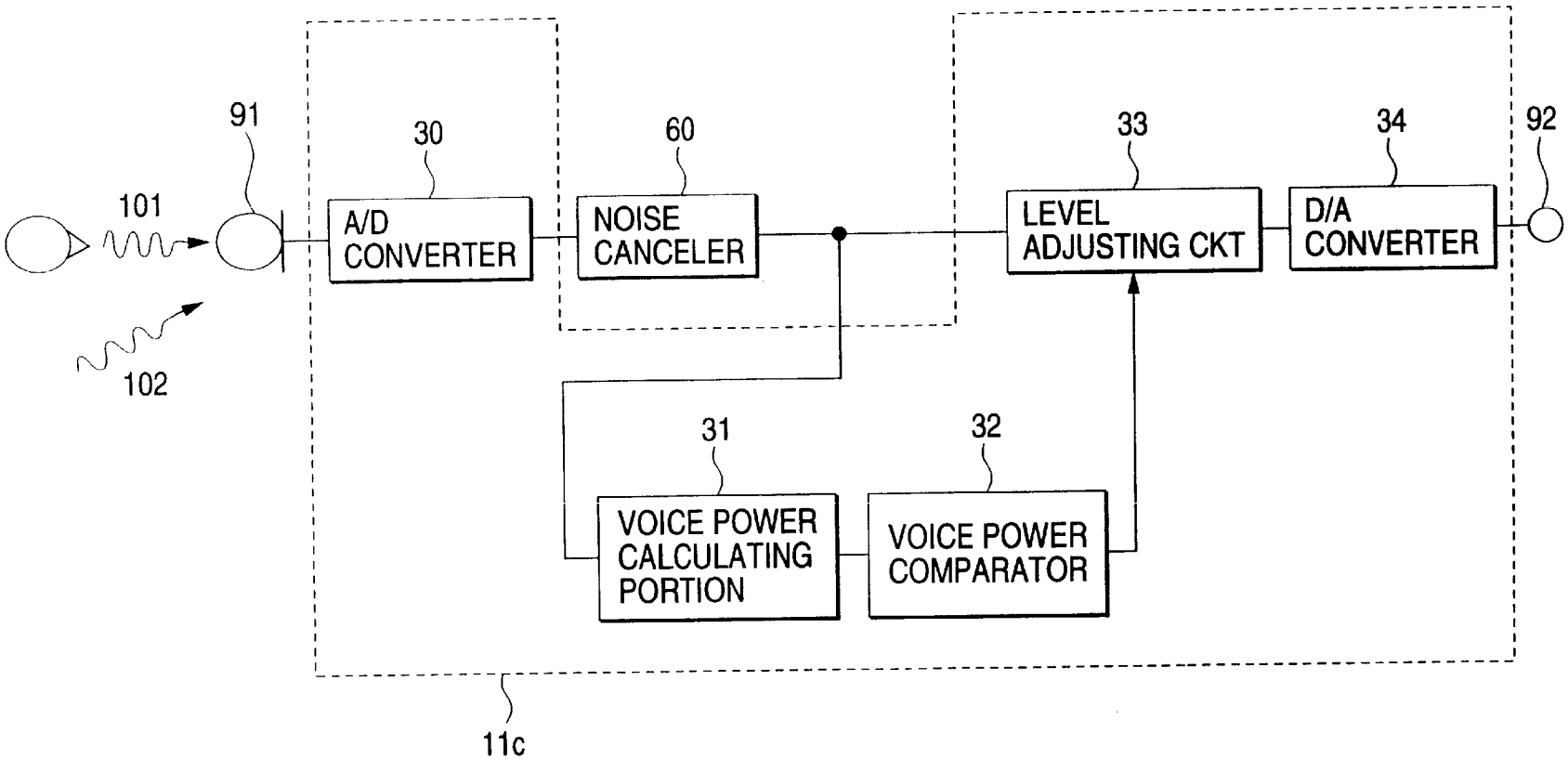
FIG. 5 is a configuration block diagram of a noise reduced speech apparatus in Embodiment 4 of the present invention.

FIG. 5 is a diagram showing the configuration of the speech apparatus in this embodiment.

In FIG. 5, the reference numeral 60 designates a noise canceler portion for removing ambient noise inputted to the transmission signal microphone 91 by digital signal processing. The same A/D converter 30, the same voice power calculating portion 31, the same voice power comparator 32, the same level adjusting circuit 33 and the same D/A converter 34 as shown in FIG. 2 are used. Accordingly, the reference numeral 11*c* designates a portion equivalent to the digital level adjusting portion 11*b* in FIG. 2.

The operation of the apparatus having the configuration in FIG. 5 will be described below.

Near-end speaker's voice 101 is converted into a transmission signal by the transmission signal microphone 91 and then the transmission signal is inputted to the A/D converter 30.

The digital signal obtained by conversion in the A/D converter 30 is inputted to the noise canceler portion 60.

The noise canceler portion 60 removes ambient noise selectively from the transmission signal and outputs the signal both to the voice power calculating portion 31 and to the level adjusting circuit 33 after improvement of S/N. Here, the noise canceler portion 60 is realized by digital signal processing. For example, the noise canceler 60 is carried out by algorithm or the like disclosed in the section 5.2.1.2 "Noise Canceler" in the first volume of Japanese Digital Car Telephone System Standard Specification RCR STD-27D.

In the voice power calculating portion 31, the voice power of the input digital signal is calculated, for example, by auto-correlation function calculation or the like which is often used in voice signal processing.

The calculated voice power level is compared with a reference voice power level stored in the voice power comparator 32 in advance, so that a signal proportional to the difference between these two levels is transferred to the level adjusting circuit 33. When, for example, the calculated voice power level is higher than the reference voice power level, a control signal is supplied to the level adjusting circuit 33 so that the level of the transmission signal is reduced. When the calculated voice power level is lower than the reference voice power level, contrariwise, a control signal is supplied to the level adjusting circuit 33 so that the level of the transmission signal is increased. When the calculated voice power level is equal to the reference voice power level, a control signal is supplied to the level adjusting circuit 33 so that the level of the transmission signal is not changed.

As described above in Embodiment 1, the level adjusting circuit 33 adjusts the level of the digital voice signal on the basis of the signal given from the voice power comparator 32 and outputs the adjusted signal to the D/A converter 34.

The D/A converter 34 converts the digital voice signal into an analog voice signal and outputs the analog voice signal to the transmitter side output terminal 92.

In practical use, the noise cancellation, voice power calculation, voice power comparison and level adjustment are executed by a general-use processor and programs installed in advance in a memory.

As described above, in the speech apparatus according to this embodiment, the SIN of the transmission signal is improved by the noise canceler using digital signal processing so that the transmission signal level is kept constant (reference transmission signal level) by the level adjusting circuit. Accordingly, a transmission signal with less fluctuation of the level can be transmitted to the far-end side without influence of near-end side ambient noise so that the far-end speaker can hear voice with a clear and stable volume.

Embodiment 5

A speech apparatus according to Embodiment 5 of the present invention will be described with reference to the drawing. This embodiment is designed so that the voice signal is made as natural as possible but the S/N is improved to suppress the fluctuation of the voice level when noise is large.

Figure 6:
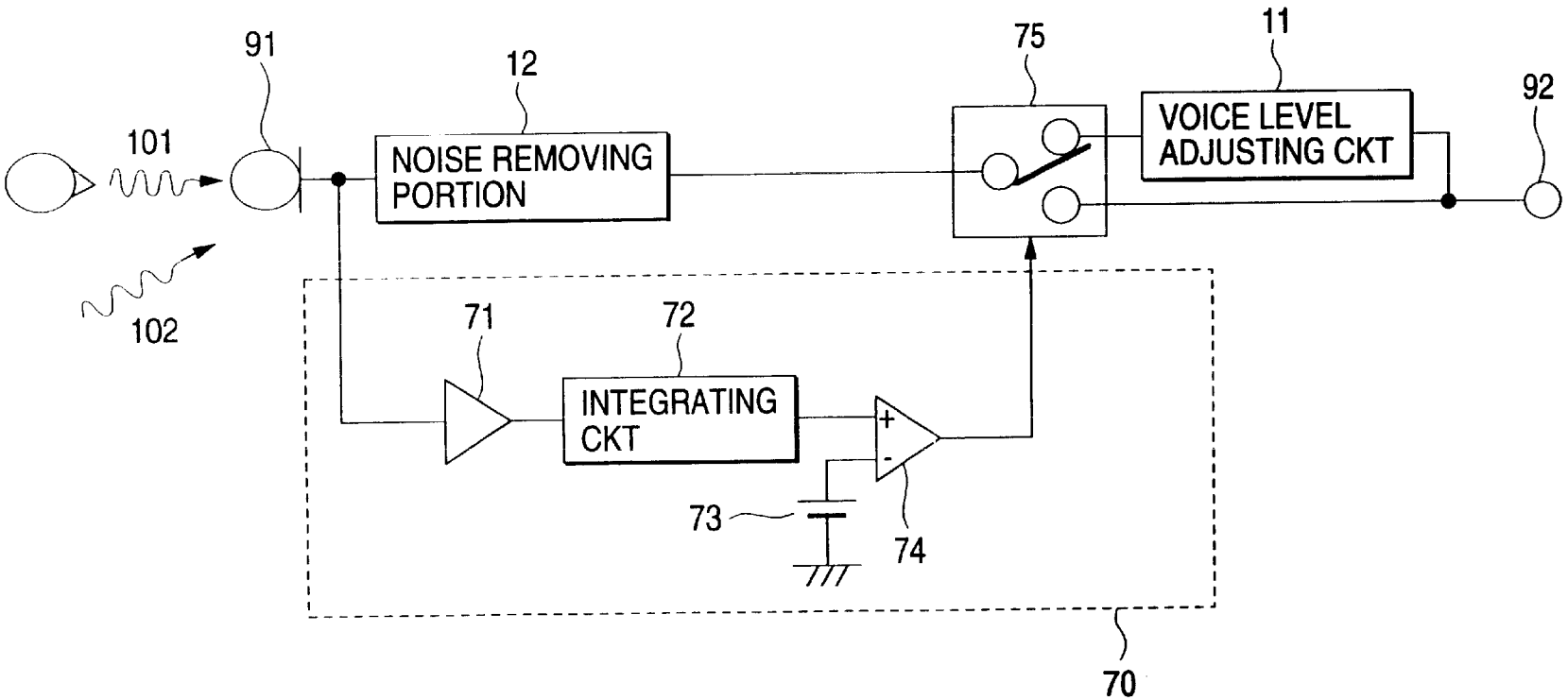
FIG. 6 is a configuration block diagram of a noise reduced speech apparatus in Embodiment 5 of the present invention.

FIG. 6 is a diagram showing the configuration of the speech apparatus in this embodiment.

In FIG. 6, the reference numeral 12 designates a noise removing portion which is, for example, equivalent to the high-pass filter 10 in FIG. 1A. The reference numeral 71 designates a rectifying circuit for converting an AC signal into a DC signal; 72, an integrating circuit for measuring the level of ambient noise from the transmission signal; 73, a reference noise level; 74, a comparator; 75, a path switching circuit for switching the path of the transmission signal; and 11, a level adjusting circuit for adjusting the level of the transmission signal. These parts constitute a noise level detecting portion 70. Incidentally, the level adjusting circuit 11 corresponds to the voice level adjusting portion 11*b* in FIG. 1B or the digital level adjusting portion 11*b* in FIG. 2. A transmission signal microphone 91 and a transmitter side output terminal 92 are the same as those shown in FIG. 1A.

The operation of the apparatus having the aforementioned configuration will be described below.

Near-end speaker's voice 101 and ambient noise 102 are converted into a transmission--signal by the transmission signal microphone 91 and then the transmission signal is inputted to the noise removing portion 12 and to the rectifying circuit 71 in the noise level detecting portion 70.

The noise removing portion 12 removes only a noise signal from the transmission signal. Specifically, this portion may be, for example, the high-pass filter 10 in FIG. 1A or the noise canceler portion 60 in FIG. 5. After the removal of noise by the portion 12, the voice signal is supplied to the path switching circuit 75.

On the other hand, the rectifying circuit 71 converts the transmission signal from an AC signal into a DC signal and supplies the DC signal to the integrating circuit 72.

The integrating circuit 72 detects only the level of noise which has a gentle leading edge, for example, of 1 to 2 seconds and a sharp trailing edge, for example, of the order of tens of milliseconds and which varies slowly with the passage of time.

The comparator 74 compares the output of the integrating circuit 72, that is, the measured noise level, with a reference noise level 73. When the comparison results that the measured noise level is higher than the reference noise level, the comparator 74, for example, outputs a signal of "high"("1"). When the comparison contrariwise results that the noise level is lower than the reference noise level, the comparator 74, for example, outputs a signal of "low"("0").

When the output of the comparator 74 is "high"("1"), the path switching circuit 75 switches the path to the level adjusting circuit 11 side. When the output of the comparator 74 is "low"("0"), contrariwise, the path switching circuit 75 switches the path to the transmitter side output terminal 92 side.

The level adjusting circuit 11 outputs a transmission signal having the level kept constant (reference transmission signal level) to the transmitter side output terminal 92 in the same manner as the voice level adjusting portion 11*a* in FIG. 1B or the digital level adjusting portion 11*b* in FIG. 2.

As described above, the speech apparatus according to this embodiment regards the level fluctuation of the transmission signal inputted to the microphone as being large when the level of ambient noise contained in the transmission signal is higher than a reference level, and adjusts the level of the transmission signal to be a constant level. When the level of ambient noise contained in the transmission signal is contrariwise lower than the reference level, the speech apparatus regards the level fluctuation of the transmission signal inputted to the microphone as being small, and transmits the transmission signal with no change. As a result, when the level of ambient noise is small, the far-end speaker can hear the received voice signal with a more natural voice level.

Embodiment 6

A speech apparatus according to Embodiment 6 of the present invention will be described below with reference to the drawing. In this embodiment, the thought of the previous embodiment is realized by another circuit structure.

Figure 7:
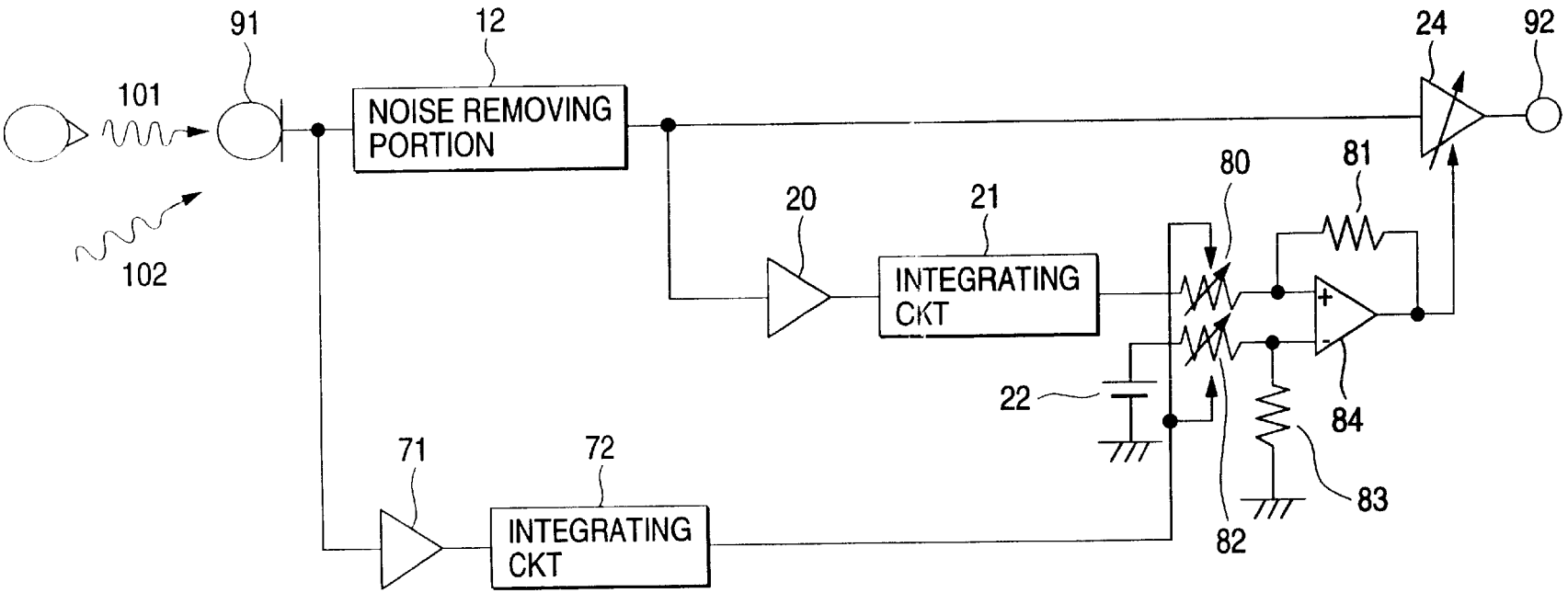
FIG. 7 is a configuration block diagram of a noise reduced speech apparatus in Embodiment 6 of the present invention.
Figure 8:
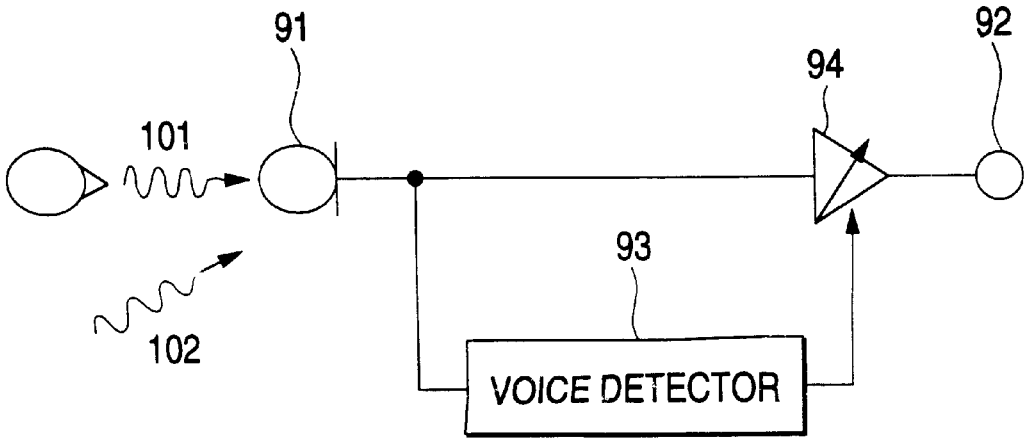
FIG. 8 PRIOR ART
FIG. 8 is a configuration block diagram of a conventional speech apparatus.

FIG. 7 is a diagram showing the configuration of the speech apparatus in this embodiment.

In FIG. 7, the reference numerals 80 and 82 designate variable resistors each having the resistance value changed by voltage; 81 and 83, resistors; and 84, an operation amplifier. The same noise removing portion 12, the same rectifying circuit 71 and the same integrating circuit 72 as shown in FIG. 6 are used. The same rectifying circuit 20, the same integrating circuit 21 , the same reference voice voltage 22 and the same level adjusting circuit 24 as shown in FIG. 1B are used.

The operation of the apparatus having the aforementioned configuration will be described below.

Voice 101 and ambient noise 102 are converted into a transmission signal by the transmission signal microphone 91 and then the transmission signal is inputted both to the noise removing portion 12 and to the rectifying circuit 71.

The noise removing portion 12 removes only the noise signal from the transmission signal.

The rectifying circuit 71 converts the transmission signal from an AC signal into a DC signal and supplies the DC signal to the integrating circuit 72.

The integrating circuit 72 has a gentle leading edge and a sharp trailing edge, that is, has a certain time constant and detects the level of noise which changes slowly with the passage of time. The noise level output of the integrating circuit 72 is used as a signal for controlling the resistance values of the variable resistors 80 and 82.

The rectifying circuit 20 converts the transmission signal after the removal of noise from an AC signal into a DC signal. The integrating circuit 21 integrates the intensively fluctuating DC signal with respect to a certain time constant to thereby output a stabilized DC voltage signal.

The variable resistors 80 and 82, the resistors 81 and 83 and the operation amplifier 84 constitute a differential amplifier which amplifies the difference between the level of the DC voice signal as the output of the integrating circuit 21 and the reference voice voltage 22 and outputs a signal as a control signal of the level adjusting circuit 24. As described above in Embodiment 1, the differential amplifier outputs a signal so that the gain of the level adjusting circuit 24 is reduced, for example, when the DC voice signal is higher than the reference voice voltage 22, while the differential amplifier outputs a signal so that the gain of the level adjusting circuit 24 is increased when the level of the DC voltage signal is lower than the reference voltage. When the level of the DC voltage signal is equal to the reference voltage, the differential amplifier outputs a signal so that the gain of the level adjusting circuit 24 is set to 0 dB.

The amplification factor of the aforementioned differential amplifier is determined on the basis of the ratio of the resistor 81 to the variable resistor 80 and the ratio of the resistor 83 to the variable resistor 82. That is, the control signal given to the level adjusting circuit 24 can be adjusted by controlling the values of the variable resistors 80 and 82 (correspondingly to the magnitude of ambient noise), so that the level of the transmission signal to be transmitted can be adjusted correspondingly to the level of ambient noise. For example, if characteristic is given so that the resistance values of the variable resistors 80 and 82 are reduced when the level of ambient noise is large, the gain of the differential amplifier is increased so that a control signal having the level accurately (for example, within ±5%) coincident with the reference voice level which corresponds to the reference voice voltage 22 is outputted to the level adjusting circuit 24. If characteristic is contrariwise given so that the resistance values of the variable resistors 80 and 82 are increased when the level of ambient noise is small, the gain of the differential amplifier is reduced so that a control signal near (for example, within ±20%) the reference voice level which corresponds to the reference voice voltage 22 is outputted to the level adjusting circuit 24.

As described above, in the speech apparatus according to this embodiment, the level-of ambient noise is monitored so as to be used as a reference signal for adjusting the level of the transmission signal. In this manner, because the fluctuation of the speaker's voice level increases as the level of ambient noise increases, the level adjusting circuit adjusts the level of the transmission signal so that the level of the transmission signal approaches the reference voice signal level. Because the fluctuation of the speaker's voice level contrariwise decreases as the level of ambient noise decreases, the level adjusting circuit adjusts the level of the transmission signal so that the level of the transmission signal roughly approaches the reference voice signal level. As a result, the far-end speaker can hear the voice with a stable and natural volume regardless of the level of near-end side ambient noise.

As described above, according to the present invention, there are provided a specific component removing means for removing ambient noise inputted to a microphone, and a level adjusting means for adjusting the voice level of the transmission signal after the removal of ambient noise to a constant level. Accordingly, there arises an effect that clear and stable voice is transmitted to a far-end while the level of near-end side ambient noise is reduced.

Furthermore, there are provided a specific component removing means, a noise level detecting means, a changeover switch, and a transmission level adjusting means. Accordingly, there arises an effect that the level adjusting means is bypassed to transmit more natural voice to a far-end when ambient noise is small.

Furthermore, there are provided a specific component removing means, a noise level detecting means, and a transmission level adjusting means. Accordingly, there arises an effect that voice having a moderate level can be transmitted to a far-end even in the case where ambient noise is extremely large or extremely small.

The foregoing description of a preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A speech communication apparatus, comprising:

input means for receiving sounds including speech and ambient noise and converting said received sounds into a speech-plus-noise signal;

noise component removing means for removing noise components from said speech-plus-noise signal to produce a noise-reduced speech signal; and level adjusting means for receiving said noise-reduced speech signal and adjusting the amplitude of said noise-reduced speech signal to provide a constant level output noise-reduced speech signal for transmission to a receiver.

2. A speech communication apparatus according to claim 1, wherein said noise component removing means comprises a high-pass filter.

3. A speech communication apparatus according to claim 1, wherein said noise adjusting means comprises a rectifying circuit, an integrating circuit and a voice level adjuster adjusted on the basis of an output of said integrating circuit.

4. A speech communication apparatus according to claim 1, wherein said level adjusting means comprises an A/D converter, a voice power calculating portion, a voice power comparator and a digital level adjuster adjusted in gain on the basis of a value after the power calculation and comparison.

5. A speech communication apparatus according to claim 1, wherein said noise component removing means comprises a noise collection microphone and a portion equivalent to a subtractor for subtracting noise components collected by said noise collection microphone from the input voice.

6. A noise speech communication apparatus according to claim 1, wherein a differential microphone with two inputs which converts input voice into an electric signal is used as said noise component removing means, one input of the microphone being used for voice input and noise collection, the other input being used for noise collection.

7. A speech communication apparatus according to claim 4, wherein a digital noise canceler for performing noise cancellation by frequency analysis of the output of said A/D converter is provided as said noise component removing means.

8. A noise communication speech apparatus according to claim 1, further comprising:

a changeover switch for bypassing said level adjusting means provided between said noise component removing means and said level adjusting means; and a noise level detecting means;

when the noise level detected by said noise level detecting means is small, said changeover switch is adjusted so that said level adjusting means is bypassed.

9. A speech communication apparatus according to claim 1, further comprising a noise level detecting means for detecting the noise level on the basis of which the gain of said level adjusting means is adjusted.

10. A speech communication method, comprising the steps of:

canceling noise components in an input voice signal;

calculating the power of said voice signal after the noise cancellation;

comparing the calculated power of said voice signal with a reference voice power level; and adjusting the level of said voice signal after the noise cancellation on the basis of the result of the comparison to provide a constant level voice signal for transmission to a receiver.

* * * * *

UNITED STATES PATENT AND TRADEMARK OFFICE

CERTIFICATE OF CORRECTION

PATENT NO. : 6,363,344 B1
DATED : March 26, 2002
INVENTOR(S) : Koji Higuchi

It is certified that error appears in the above-identified patent and that said Letters Patent is hereby corrected as shown below:

Column 2,
Line 20, “provided-between” should be -- provided between --.

Column 3,
Line 53, “of-the” should be -- of the --.

Column 4,
Line 6, after “level” insert -- ) --;
Line 34, “the-voice” should be -- the voice --.

Column 5,
Line 33, after “signal” the semi-colon “;” should be a comma -- , --.

Column 6,
Line 4, “11b” should be -- 11a --.

Column 8,
Line 60, “11b” should be -- 11a --.

Column 10,
Line 66, “level-of” should be -- level of --.

Column 11,
Line 55, after “and” insert -- continuously --;
Line 57, after “output” insert -- of said --.

UNITED STATES PATENT AND TRADEMARK OFFICE

CERTIFICATE OF CORRECTION

PATENT NO. : 6,363,344 B1
DATED : March 26, 2002
INVENTOR(S) : Koji Higuchi

It is certified that error appears in the above-identified patent and that said Letters Patent is hereby corrected as shown below:

Column 12,
Line 5, “noise” should be -- level --.
Line 20, delete “noise”;
Line 31, delete “noise”;
Line 37, before “when” insert -- wherein --.

Signed and Sealed this

Twenty-fifth Day of March, 2003

JAMES E. ROGAN
*Director of the United States Patent and Trademark Office*